United States Patent [19]

Fontana

[11] Patent Number: 4,765,596

[45] Date of Patent: Aug. 23, 1988

[54] RACETRACK CONVERTIBLE GUARDRAIL

[76] Inventor: Richard Fontana, 8525 Bella Vista, Alta Loma, Calif. 91701

[21] Appl. No.: 944,745

[22] Filed: Dec. 22, 1986

Related U.S. Application Data

[63] Continuation-in-part of Ser. No. 780,010, Sep. 25, 1985, Pat. No. 4,635,905.

[51] Int. Cl.[4] ..... E04H 17/14

[52] U.S. Cl. ..... 256/65; 256/59; 403/223

[58] Field of Search ..... 256/59, 65, 66; 403/223, 361, 221; 52/165, 169.13, 298

[56] References Cited

U.S. PATENT DOCUMENTS

| | | | |
|---|---|---|---|
| 2,679,911 | 6/1954 | Bhend | 52/298 |
| 3,048,432 | 8/1962 | Harter | 403/221 |
| 3,135,364 | 6/1964 | Luttrell, Jr. | 52/298 X |
| 3,374,986 | 3/1968 | McElroy et al. | 256/59 |
| 3,443,002 | 4/1984 | Fontana | 256/59 |
| 4,556,201 | 12/1985 | Turner | 256/59 |

FOREIGN PATENT DOCUMENTS

| | | | |
|---|---|---|---|
| 974055 | 11/1964 | United Kingdom | 256/59 |

*Primary Examiner*—Andrew V. Kundrat
*Attorney, Agent, or Firm*—George F. Bethel; Patience K. Bethel

[57] ABSTRACT

A racetrack convertible guardrail is disclosed herein which includes a plurality of spaced apart upright curved posts or stanchions. The curved posts or stanchions serve to support a racetrack rail which can be formed of metal or wood. Overlying the rail and the stanchions are a continuous number of sheets interfacing with each other to cover the stanchions and the rail for protection of a rider and a horse. Underlying the rail, stanchions and the protective cover is a second rail in the form of tubing or other rail forms supported by a hinged arm that can be utilized for sulky racing. The rail forms are supported by means of collars that are in turn supported by the hinged arm that underlies the stanchion. The collar and the tubing or rail forms can be connected to another form of stanchion that has a stake for supporting the stanchion, rail and tubing with the collars for purposes of grass racing and which can be removed by moving said stake and other components of the rail. The stake and other components can be seated within a ground fixture. The ground fixture is formed of a first flexible outer tube portion and a second inner tube portion seated interiorly of said first outer tube portion and adapted for placement in the ground wherein the first outer tube portion extends beyond said inner tube portion and is adapted for exposure to the ground surface so that impacts against said first outer tube portion are received against a flexible tubular member and said second inner tubular portion is of a fixed resilient nature for holding the stake therein.

18 Claims, 6 Drawing Sheets

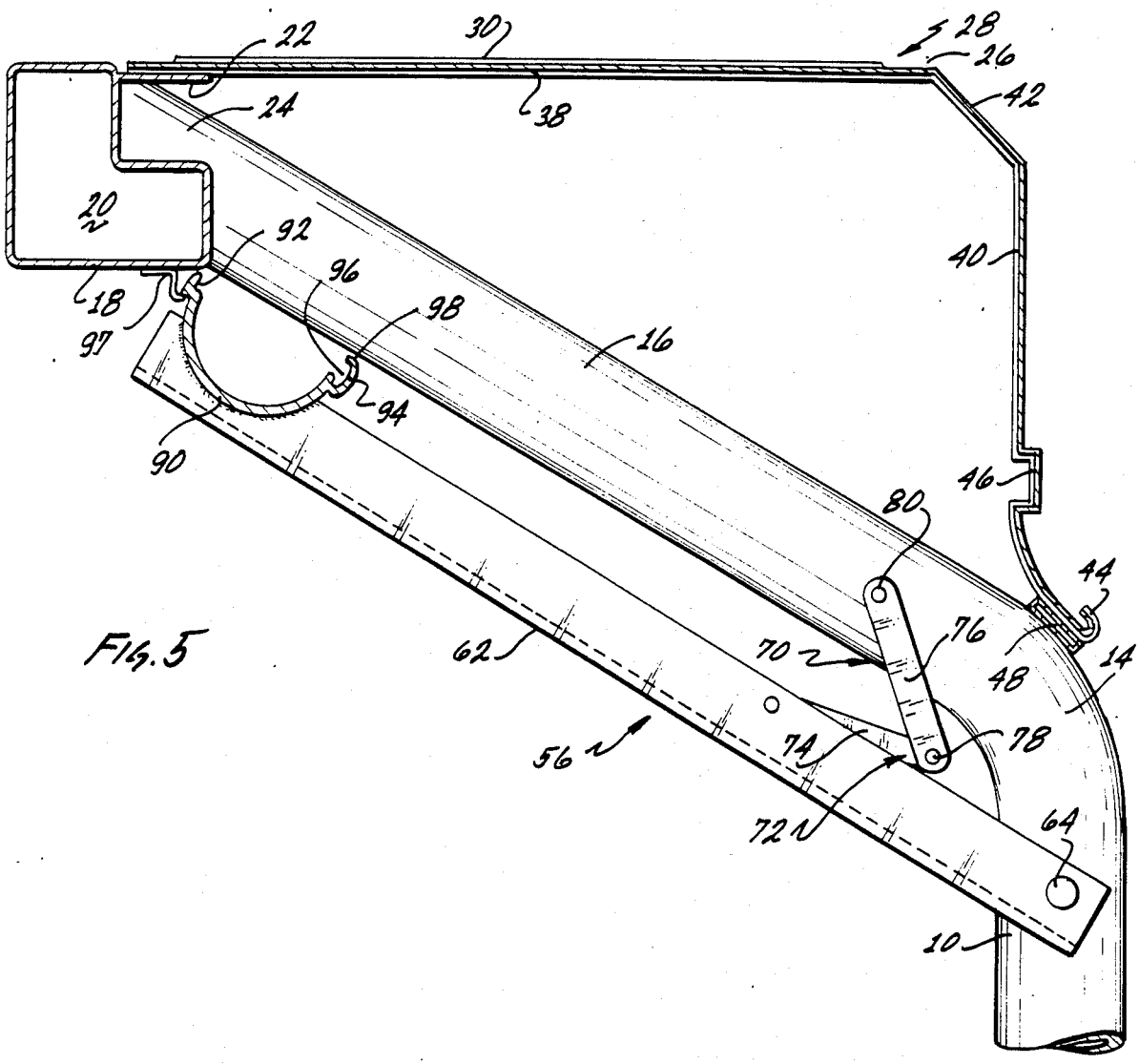
FIG. 5
FIG. 6
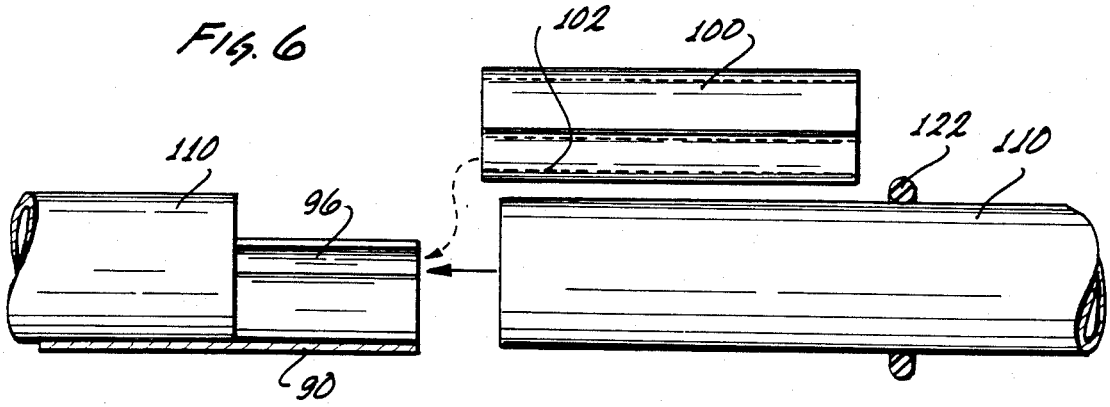

RACETRACK CONVERTIBLE GUARDRAIL

This is a Continuation in Part of U.S. patent application Ser. No. 06/780,010, now Pat. No. 4,635,905, filed Sept. 25, 1985 by Richard Fontana as sole inventor, entitled Racetrack Convertible Guardrail.

FIELD OF THE INVENTION

The field of this invention lies within the horse racing art. In particular, it lies within the art of guardrails for horses on tracks that can be dirt tracks used for thoroughbred racing. It also lies within the area of horse racing that utilizes rails for protection of racers in sulky racing. In addition thereto, it addresses the field of horse racing on grass, where grass tracks are utilized with protective railings.

THE PRIOR ART

The prior art of rails for horse racing involves generally fixed rails. The rails extend around the inside of the track. They are usually comprised of a stanchion or post. The stachions or posts are curved and support a rail which extends around the inside of the track. This rail is the rail which guides the horses and the riders around the extent of the track.

Recently, the inventor hereof has substantially improved the state of the art by providing a rail with a substantial safety feature. The safety feature is in the form of a series of elongated protective panels. The elongated protective panels extend between the posts on the rail and serve to cover the post and rail.

The foregoing post and rail covering can be exemplified by the inventor's U.S. Pat. No. 4,443,002, issued Apr. 17, 1984. It can be seen therein that the inventor has invented an elongated series of panels that are shaped to fit over the stanchions or posts and rail. This serves to protect the riders and horses from falling into the stanchions or the curved portion thereof and becoming severely injured.

The foregoing invention was an advance over the art cited therein, including the U.S. patents incorporated herein by reference as prior art that were cited in the patent.

This invention directs itself to not only a protective rail and stanchion or post configuration, but the convertibility of such tracks equipped therewith and with a standard post and rail to other types of tracks. In particular, it addresses itself to the utilization of the posts and rails of a regular track in conjunction with a second system for providing sulky racing.

In the past, sulky racing has had to use a particular type of rail different from the type used for regular horse racing. This, of course, presented problems with regard to changing one track rail to another.

There have also been attempts at changing the track rail of a standard racehorse track to another. Such activities have not met with a great degree of success. Generally, the tracks have to be such wherein they incorporate two different types of rails, or two different types of tracks have to be established. Also, existing art demands that one particular rail be removed or be supplemented with another in an imcompatible manner in order to provide horse racing and sulky racing on the same track.

This invention is directed toward allowing for convertibility of a standard racetrack into a sulky racetrack by merely lowering an arm that is pivoted on a pair of support brackets. The arm moves upwardly and downwardly on the post underneath the rail and protective cover. At the end of the arm is a semicircular collar with splines and channels on the edge regions thereof. The splines and channels on the edge regions receive a second semicircular collar thereover in relationship therewith in order to hold a rail. The rail can be in the form of pipes or rails that extend into the two semicircular collars in mated abutting relationship.

When the semicircular collars have been implaced, they hold the pipe or rail with the arm and the depending brackets holding the arm outwardly. The entire structure can then be used as a sulky guide rail extending from a standard horse racing rail. This is an advance over the art, inasmuch as it can be used at any particular time by merely lowering the arm and inserting the pipes into the collars which form the rail around the length of the track.

In addition to the foregoing, there has been a form of grass track horse racing over the years. The grass track racing has generally incorporated rails that can be moved to avoid wearing the turf in one spot. Also, there are portable fences that have significant moving costs attendant therewith, in order to move them into different areas on a grass track.

It is oftentime customary to have a grass track with portable rails moved to different locations in order to prevent the turf of the grass track from being unduly trod upon in one particular location on a constant basis. This is accomplished by means of moving the rail inwardly and outwardly around the track and providing for different locations on the grass.

During the movement of such rails and fencing, it becomes a complex situation to disassemble the rails, move them and set them up again. This invention overcomes the foregoing complexity by providing movable stakes which can be pounded into the ground and are such that they support a series of pipes or rail tubing on the stanchions or posts. The grass track rail tubing is supported in the same manner as the prior described sulky tubing on the stanchions or posts. This is accomplished by having a semicircular collar attached to a stanchion. A second semicircular collar fits over the first collar and receives pipe rail therein in order to form a completed rail for a grass track.

The stanchions are supported on the stakes which are driven into the ground. The stakes have a specific configuration to prevent the discoloring of grass thereunder so that horses are not frightened by seeing whitened spots or dead spots of grass when they are racing in an area which had previously had stakes driven thereunder.

This invention further provides an improved implacement means for placing stanchions or rail support uprights within the ground. In particular, it incorporates means for providing a number of implacement fittings, sockets, fixtures, or openings on a racetrack that is a grass type of track in pre-established locations so as to provide for removal and placement in other areas while at the same time not damaging the hoofs of the horses or endangering riders and horses from serious accidents.

This invention not only provides for portability and movement of grass track guard rails, but also enhancement of regular tracks for sulky racing. As a consequence, it is a substantial improvement over the art and as will be seen in the following specification, has a significant degree of patentability attendant therewith.

SUMMARY OF THE INVENTION

In summation, this invention comprises an improved horse racing rail that can be used interchangeably for thoroughbred track racing, sulky racing, and incorporates interchangeable elements for grass track racing.

More particularly, it incorporates a post or stanchion that is a normal horse racing stanchion that supports a rail around the inside of a track. The stanchion and rail can be optionally covered by a safety panel that is known in the prior art through the development of the inventor hereof.

Extending from the stanchion or post is a pivotal arm. The pivotal arm can swing from the upper inside portion of the stanchion or post at the curved portion thereof downwardly and be supported by two pivotal brackets. The arm supports a first semicircular collar. The first semicircular collar on the arm receives a second semicircular collar thereover. Between the two semicircular collars, a section of pipe or rounded rail can be inserted. This pipe or rounded rail is secured therein and serves to provide a rail on the inside of the track at a lowered area for sulky racing. The sulky rail and support when not in use is removed and the arm is swung upwardly into the underportion of the optional panel and the stanchion. This provides for a disposal or stowing of the sulky rail support so that the upper rail of the track can then be used for normal racing purposes.

The combination of the two respective semicircular collars can be utilized in conjunction with a stanchion supported on a stake. The same tubular or circular pipe or rail can be fitted into the semicircular collars and held by the stanchions. This effectiely provides for a support thereof on the stake so as to avoid duplication of rails between grass track racing and sulky racing. In addition thereto, the stake can be moved on a grass track that supports the stanchions and rails in an effective manner to avoid undue wear on the grass track.

In order to enchance the movement of the stakes holding the stanchion to various places on the grass track, the inventor has provided for the insertion of the stakes into the ground in a unique manner. The insertion of each stake is provided by an opening in the ground that has been fitted with an outer flexible tubular member and an inner rigid resilient tubular member for receiving the stake. The outer tubular member extends to the top surface or above the ground slightly while the resilient inner tubular portion is below the level of the ground so that when horses trod thereover, their hoofs and legs will not be shocked or damaged by impacting a concrete or metal member inserted into the ground. Furthermore, avoidance of injury is enchanced by the fact that falling riders and horses will not impact a stiff resilient member in the ground.

Thus, the entire invention can be used with interchangeable parts hereof to provide normal horse racing, sulky racing, and grass track racing in an easy and facile manner.

BRIEF DESCRIPTION OF THE DRAWINGS

The invention will be more clearly understood by reference to the description below taken in conjunction with the accompanying drawings wherein:

FIG. 5 shows a view of the sulky rail and pivotal support arm when it is not in use and folded up under the stanchion or posts.

FIG. 6 shows a view of the sulky rail semicircular collars that support and surround the elongated pipe or rail with the top semicircular collar covering the rail and being implaced therein with the pipe or sulky rail.

DESCRIPTION OF THE PREFERRED EMBODIMENTS

Figures 1, 3:
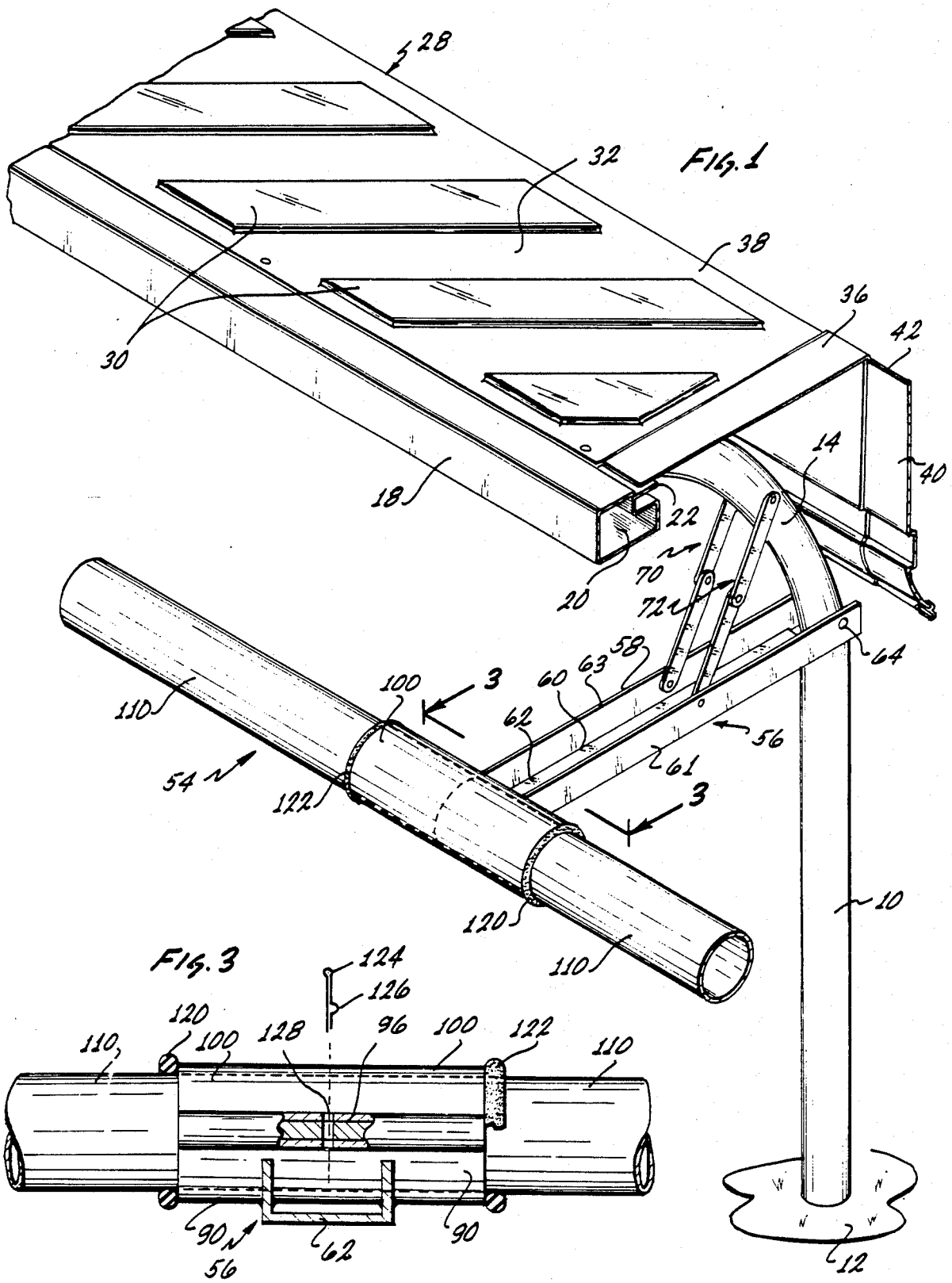
FIG. 1 shows a perspective view of a racetrack rail of this invention incorporating the sulky rail supported on the pivotal arm with the semicircular collars and the tubing or rail within the sulky rail support.
FIG. 3 shows a sectional view as fragmented in the direction of lines 3—3 of FIG. 1 of the semicircular collar connection means for the sulky rail of the invention.

FIG. 1 shows a perspective view of a seciton of the protective racetrack rail of this invention that incorporates the sulky racetrack rail therewith. Looking more particularly at FIG. 1, it can be seen that a stanchion 10 or post has been shown implaced within the ground 12. The stanchion 10 or post can be implaced in any particular manner, such as being driven into the ground on a permanent basis or set in concrete or other permanent means. It can also be implaced in the ground 12 by a temporary securement, such as a post or fitting, over which the stanchion 10 is set or secured to such as that exemplified in FIGS. 7 and 8.

Figure 2:
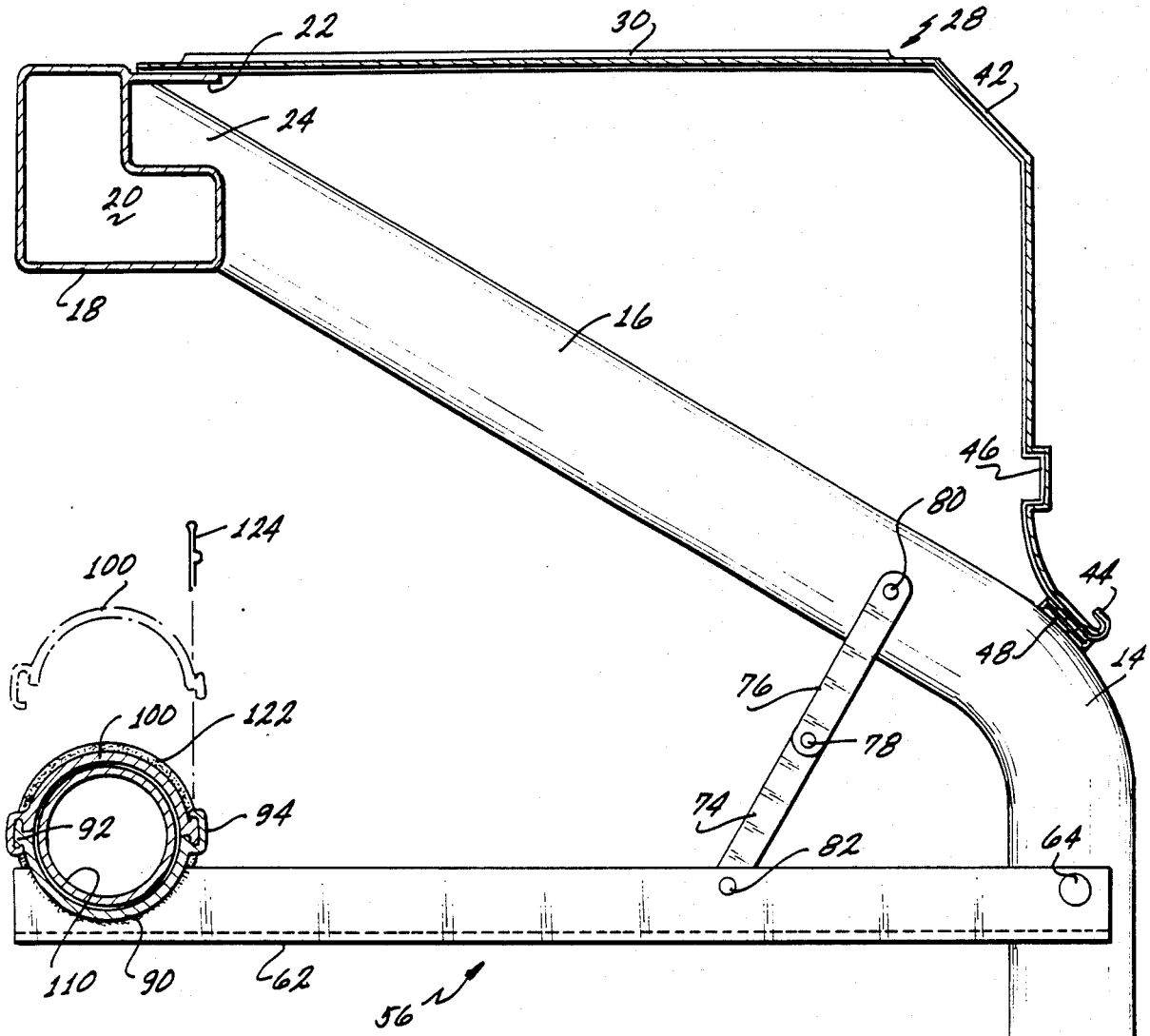
FIG. 2 shows a side elevation view that has been sectioned and a portion of the semicircular rail support collar has been shown in removed orientations for explanatory purposes.
Figure 4:
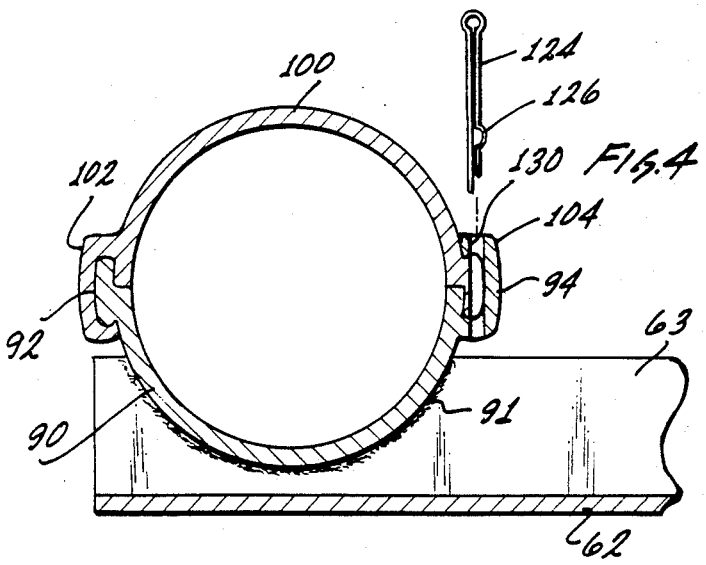
FIG. 4 shows a sectional and fragmented view of the detail of the semicircular coupling means for the sulky rail as sectioned through the midline of the showing of FIG. 3.

The stanchion 10 curves upwardly in a generally curved section 14 into an angularly bent portion 16 that can be seen more specifically in FIG. 5 and FIG. 2. This upwardly extending angular portion 16 can be in any particular configuration. It is not necessary that it angularly extend in the manner shown or the bend 14 in the stanchion be incorporated in the foregoing manner. In effect, the stanchion 10 can be bent with a double gooseneck, or bent in a multitude of sections or curved continually in any manner to allow for the bending over for implacement of a rail at the end thereof.

Looking more particularly at the figures, it can be seen that a rail 18 is shown. The rail 18 has an L shaped hollow cross section with a space 20 within the L shaped cross section. The rail 18 is formed from an extrusion of aluminum or any other suitable material. Extending from the upright portion of the L, is a flange or ledge 22. This flange or ledge 22 creates a space 24 between it and the lateral portion of the L shaped member.

The rail 18 can be substituted by any other suitable rail. In the prior art, it has been known that rails made of wood have been utilized, such as in the inventor's prior patent. Thus, it is readily seen that wood and metal rails of all types and other configurations can be used to provide the rail function of rail 18. Furthermore, a plastic rail can be utilized formed of any particular material attached to the post or stanchions 10 in any particular manner.

The rail 18 with the flattened ledge or flange 22 supports a panel 28. The panel 28 is shown having an upper surface with a plurality of diagonal guides 30. The diagonal guides 30 are raised bosses or strips on the surface of the panel 28. The raised bosses or strips on the surface of the panel 28 provide for channels 32 between the guides 30. The purpose of the guides 30 is to guide an object over the surface thereof angularly out into the field when impact takes place. It is felt that the guides 30 with the channels 32 therebetween tend to guide a rider or horse or other object when impacting the panel in the direction of the in field of the track.

Each panel 28 is formed in a section so that it spans the respective space between the stanchions 10. The panel 28 in this particular instance is shown as a panel with a joindure lip 36. The joindure lip allows for the insertion of an adjacent panel next to it in mating configuration, so that it fits between the space of the joindure lip 36 and the top of the ledge or flange 22. The joindure lip 36 can be in the form of any suitable expansion or offset ledge allowing for a mating panel member to be slid thereunder. Each panel member has a lip or ledge 36 at one end thereof, to allow for an adjacent panel to be slid thereunder or be mated therewith.

The panel 28 is comprised of an L shaped member formed of a plastic. The L shaped member has one portion in the form of a lateral portion 38 which terminates in an upright portion 40. Between the lateral portion 38 and upright portion 40 is an angular corner section 42. The angular corner section 42 provides rigidity and reinforcement as well as a more resilient surface when an impact takes place. The panel in the form of the upright portion 40 terminates in a turned back end 44 and has a reinforcing boss or ridge 46 therein. The panel 44 at the end thereof is attached to the post or stanchion 10 by means of a connector 48. The connector can be in the form of any suitable connection means for securement such as bolts, metal screws, adhesives, plastic connectors, rivets, or any other suitable fastening means.

Beneath the panel 28 is a railing assembly 54. The railing assembly 54 swings down on a pivotal arm 56. The pivotal arm 56 is comprised of a channel arm member 58 having a channel conformation or groove 60 between two upright walls 61 and 63, and a bottom portion 62. The bottom portion 62 and the upright walls serve to form a U shaped channel.

The U shaped channel forming the arm 56 is pivotally connected by means of a bolt 64 to the stanchion 10. The bolt 64 can be substituted by means of a rivet, plastic snap connector, screw, rod, or any other suitable means for allowing the arm 56 to be pivoted on the stanchion 10. In order to enhance the pivoting, a cutout portion of the base 62 is provided so that the ends of the walls forming the U shaped member can be attached by the bolt or rod 64 to the stanchion 10.

The specific configuration of the pivotal arm 56 allows for the arm to be dropped down from beneath the panel. In order to support and guide the arm, two sets of brackets are utilized. The brackets are pivotal securement or holding brackets 70 and 72. The holding brackets 70 and 72 each comprise a lower portion 74 connected to an upper portion 76. They are interconnected by means of a pin, bolt or rivet 78. The upper portion or upper arm 76 of the bracket is connected to the angular portion 16 of the stanchion 10 by means of a bolt, rod or screw 80 that allows the upper arm 76 of the bracket to pivot therearound. The lower arm portion of the bracket 74 is connected to the pivotal arm 56 by means of a bolt, rod or screw 82 passing from the lower portion 74 through the upright walls 61 and 63 on either side of the arm 56.

The foregoing configuration permits the arm 56 to be raised and lowered by any suitable means to allow for positioning of the pivotal arm 56 in a generally outstretched manner from the stanchion 10. This outstretched manner is generally shown as effectuating a horizontal relationship normal to the upright portion of the stanchion 10. However, as can be appreciated, any particular angular configuration of the positioning of the arm 56, which is sufficient to provide the functions hereof, can be used. It is not necessary to position it in a horizontal manner, or in the normal manner from the stanchion 10.

The arm 56 serves to support a lower first or semicircular collar 90. The collar 90 is formed in a manner so that it has an offset flange or L shaped ridge 92 and a channel member 94. The channel member 94 is provided along the edge of the collar 90 and forms an interior opening thereof having an interior channel surface matching the ridge or flange 92. The interior opening can be seen more clearly in FIG. 5 wherein the channel member 94 can be seen with an opening or passage between the channel walls. The channel member 94 is formed with a hooklike portion 98 which bends backwardly and inwardly to provide the groove or opening 96 in the channel member 94. The foregoing is fundamentally the reciprocal of the flange 92 that can be seen so that it can be formed and mated within the opening 96. In this manner, it can receive a like semicircular collar 100 shipped into relationship therewith, so as to be mated and provide a complete encapsulation of a member between both collars.

As can be seen, a semicircular collar 100 is shown having a channel member 102 analogous to channel member 94 and a flange 104 analogous to flange 92. The foregoing respective flanges and channels mate with each other and are reciprocal so that one can be used as a bottom portion or the top portion respectively, enabling easy and facile manufacture of the entire rail assembly. The two parts are formed from one aluminum extrusion, enabling one part to serve both functions. Any particular flange, channel, chamfer, receipt, lock fitting, can lock, buckle, hinge, snapover arrangement or other means can be used in order to provide the holding of the two respective semicircular collars. Furthermore, any means can be utilized to function in place of the semicircular collars in generally analogous relationship for holding the rail, as will be described hereinafter.

Looking more particularly at FIG. 3, it can be seen wherein the collars 90 and 100 have been assembled. The lower collar 90 is welded or attached by any suitable means to the arm 56, so that it supports it. The overlying collar 100 is slid into place by means of matching the channel portion 102 to the flange 92 and the flange 104 within the channel member 94. They are slid together in the foregoing manner as can be seen within FIG. 6 whereby they come together in a mating manner in order to hold the rails, as will be detailed hereinafter.

Looking more particularly at the rails, it can be seen that tubular pipelike portions 110 are shown. These tubular pipelike portions 110 roughly correspond to the same distance as the panels 28 and span the area between the stanchions 10. They are inserted in generally abutted relationship as can be seen in FIG. 3. The abutted relationship provides for an implacement of the rail formed of the pipe 110. The rail formed of the pipe 110 allows for continuity and configurative rail patterns all the way around the track at a height lower than the upper rail 18. Thus, it accommodates sulky races on a track.

The configuration of the collars 100 and 90 can be of any suitable configuration generally matching the rail 110 formed of the pipe. Thus, if the pipe that forms the rail is square, ogive, semicircular, or of any other cross section, the collar 90 and 100 should match the cross section in order to accommodate and allow for the holding thereof in juxtaposition to the interior dimension within the collars 90 and 100. Thus, the inside configuration and dimensions of the collar should generally be configured to conform to the pipe or rial outside configurations and dimensions in order to allow them to seat therein.

In order to allow for a smooth transition area between the pipe 110 and the collars 90 and 100, two O rings 120 and 122 are utilized. The O rings 120 and 122 are such wherein they allow for a smooth and elastomeric transition as far as the step or ledge goes between the outside dimensions of the collars 90 and 100 and the pipes 110. Thus, they provide somewhat of a protected surface. Any form of ring, collar, plastic clip, flange, or spline can be utilized in place of the O rings 120 and 122, the thought being that they should provide for less tearing and destructiveness of any object bumping into the interface of the collars 90 and 100 and the pipe 110. Also, the collars 90 and 100 can have a chamfered edge, rather than having the covering. They can taper and fair downwardly circumferentially or have a fillet toward the pipe 110 or have any other conformation which allows for a smooth transition between the two respective portions of the collars and pipe.

In order to hold the collars together, a pin, such as a cotter pin 124 is shown. The pin has a protuberance 126 which allows it to be implaced within an opening 128 of the collar members 92, 94 and 102 and 104. This opening can be seen as an opening 130 into which the pin 124 passes into the opening of the flange and channel of the collar. Thus, the collars 90 and 100 are attached to each other on a removable basis and can be held so that they do not slide backwardly and forwardly by virtue of the relationship of the pin 12 holding them against longitudinal movement with respect to each other. Any particular type of attachment can be utilized in order to secure the collars together in overlying relationship. Suffice it to say, one should not slide with respect to the other.

The lower collar 90 has been shown welded or affixed to the arm 56 by means of a weldment. However, any other suitable attachment can be utilized whereby the weldment 91 can be substituted by an overlaying fit, notches, mating grooves, splines, bolts, rivets, or other means securing the collar 90 to the arm 56.

Figures 7, 8:
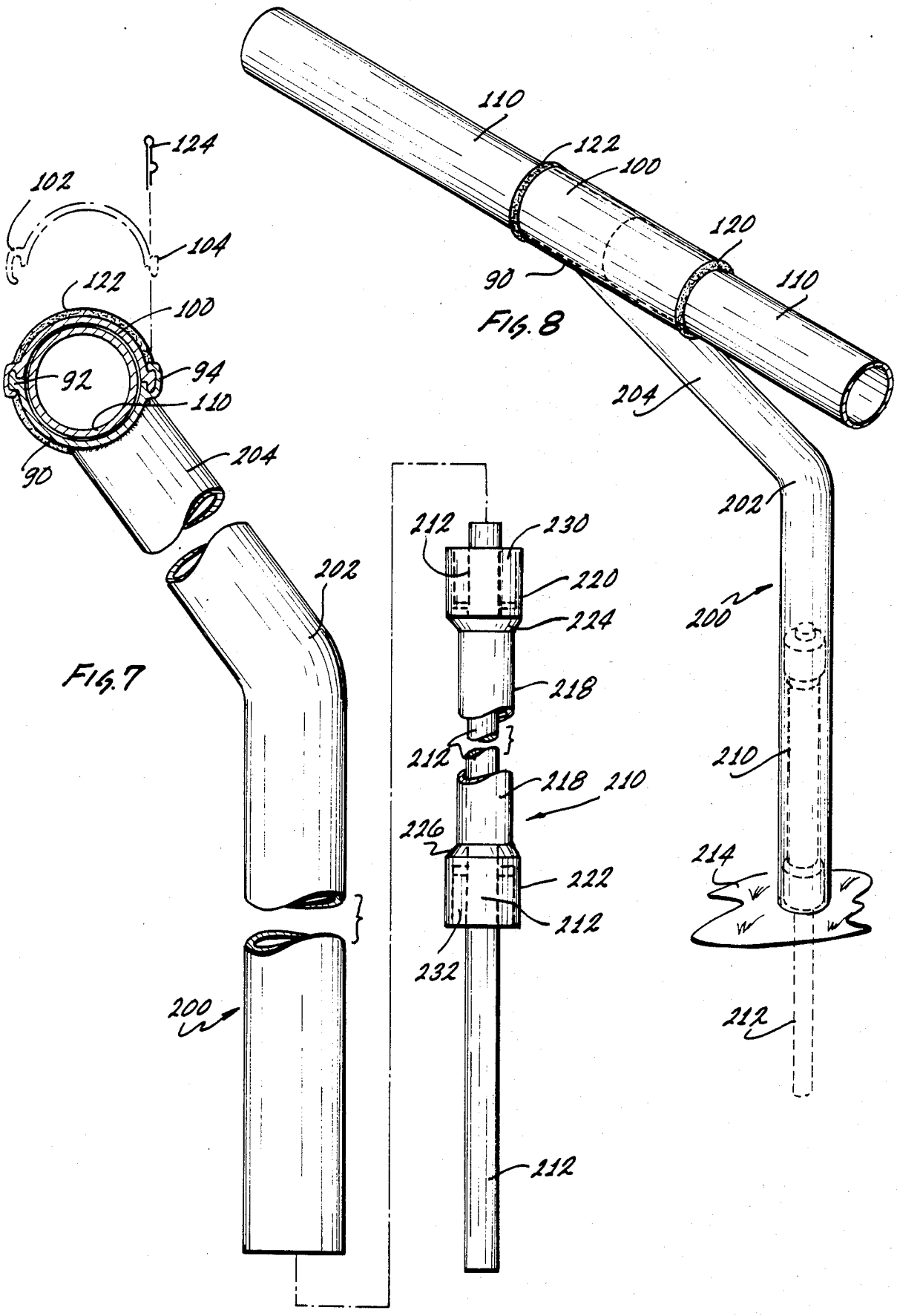
FIG. 7 shows a fragmented view of the stanchion and pipe support of this invention for grass track racing.
FIG. 8 shows a view of the stanchion and support with the rail in place for grass track racing.

Looking more particularly at FIGS. 7 and 8, it can be seen that another stanchion 200 is shown with a bend 202 terminating in an upper angular portion 204. The upper angular portion 204 receives a collar portion such as the lower collar 90. The upper collar portion 100 is shown overlying the lower collar portion 90 and can be implaced in the same manner as the prior embodiments. In this manner, the channel member 94 and flange 92 can receive the upper channel 102 and flange 104. Also, the pin 124 that is used to secure the previous upper collar member 100 to the lower collar member 90, can be utilized.

The weldment 91 welding the lower collar 90 to the arm, can be utilized to weld the lower collar to the angular portion 204, or any other suitable connection means can be utilized. Suffice it to say, the interchangeability of parts between the two respective collars 90 and 100 is analogous to the previous utilization whereby each respective channel or collar member was formed so that the reverse thereof allows it to be such wherein it engages the other channel member or collar.

Various configurations can be utilized in the way of cross sectional configurations of the collar in order to meet any outside cross sectional dimensional aspects of the pipe 110 or rail that is used. In this particular case, the pipe 110 has been shown as the rail seated within the upper and lower collar members 100 and 90. Also, the utilization of the O rings 120 and 122 are shown covering the ends of the upper and lower collars 100 and 90. However, the fairing, filleting or chamfering as in the prior embodiment, can be substituted for the O rings.

In order to mount the stanchion or post 200, a stake is shown, namely, a stake 210 is shown having a narrow rod portion 212 implanted in the ground 214. The stake 210 with the rod portion 212 has an outer pipe member 218 having an upper belled flange 200 and a lower belled flange 222. The belled-out portions terminate in shoulders 224 and 226. Each of the belled-out portions has a space respectively in the upper portion 230 and the lower portion 232 which allow the rod 212 to pass therethrough in spaced relationship. This spaced relationship is important as will be seen hereinafter.

The rod portion 212 is driven into the ground during grass racing. It can be used as a portable implacement for the stanchion 200 and effectively allows for the movable location of the track over a grass track area into various locations. Thus, the grass track can be implaced or located in any particular grass area and the stanchions 200 holding the rail 110 can be used in various locations. The only requirement is that the rod 212 forming the stake 210 be driven into the ground at a suitable location.

When the stake 210 is driven into the ground, the lower flange or bell portion 222 seats against the grass and allows the space 232 to permit the grass to grow up therein in a limited manner. This prevents the grass from being completely killed in that particular area to a significant degree. The filling of the grass would be more prominent if the space 232 were not utilized. Thus, the appearance of brown spots when the rail is moved is avoided in some measure. This is important on grass track racing, inasmuch as it can be a deterrent to horse racing because horses sometimes shy from spots on the ground.

The stake 210 can be moved at will to any particular location so as to allow the stanchion 200 to be moved with the rail support providing support for rails or pipes 110. This movement of the stanchion 200 is easily accomplished by merely lifting it over the bell portions 220 and 222 of the stake 210. The outer dimensions of the bell portions 220 and 222 generally conform to the inner dimensions of the stanchion such that the stanchion 200 can slip thereover. The stanchion should fit tightly over the bell portions 200 and 222, so as to not allow it to slip and move in a sloppy manner. However, there should be suitable clearance in order to pass the stanchion 200 thereover and withdraw it from the stake 210 when desired.

The foregoing configuration allows for multiple uses of the pipe or other configuration of rail 110 forming the rail by being utilized for grass track and regular track uses with sulky racing. Furthermore, as can be seen, the interchangeability of the collars 90 and 100 provides for utilization of the collars and securement means between various tracks for both grass racing and for sulky racing and regular tracks. Thus, the entire interchangeability of the system allows for portability of racetrack rails on grass tracks, as well as accommodating sulky racing by lowering an arm 56 with the collars 90 and 100 for recipt of rails or pipes 110 to provide for the railings of a track. Additionally, it can be appreciated that various savings are accommodated in the manufacture, as well as the interchangeability of parts for the entire grass track and regular track racing.

When the arm 56 of the regular track is not in use, it can be tucked up under the panel 28 in any suitable manner such that a clip, such as clip 97, or other suitable spring means can be utilized to allow for the folding of the arm 56 upwardly. Also, a securement pin, bolt, latch, or screw can be utilized or any other means for holding the arm 56 upwardly against the bottom of the rail 18.

Figure 9:
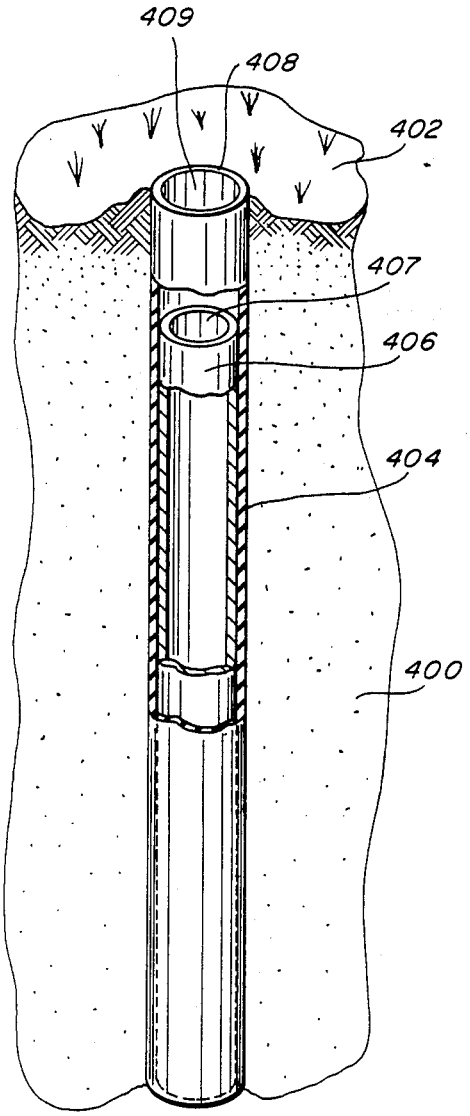
FIG. 9 shows a fragmented sectional view of the stake receipt member of fixture of this invention breaking away the outer cylindrical portion from the inner cylindrical portion to show the two respective parts thereof as inserted into the ground.
Figure 10:
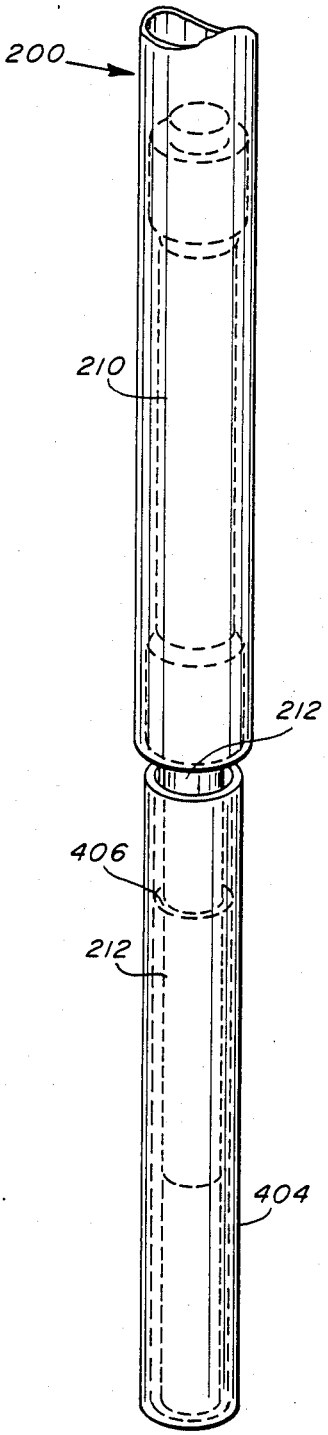
FIG. 10 shows the receipt member or fixture shown in FIG. 9 receiving a stake or post member.

Looking more particularly at FIG. 9, it can be seen wherein a surface or ground area 214 has been shown. The ground area 214 is shown in cross sectional depth wherein a cross section 400 thereof has been shown with grass 402 on top. The ground 214 can be in any track configuration such as in the track configuration shown in FIG. 11 which shall be detailed hereinafter.

The ground 214 has been drilled with a drill to remove a cylindrical area thereof. The cylindrical area is approximately twenty-three to twenty-five inches in depth.

The opening in the ground that has been bored out can be of any suitable size. It can range from large diameters to small diameters depending upon the size of the respective materials that will be implaced therein which shall be detailed hereinafter. The opening should receive the material to be implaced therein in a snug manner, but not necessarily so tight as to jam material into the opening.

For purposes of example, the following configuration shall be enunciated as to the stake or ground fixture.

An outer tubular member 404 is shown. The outer tubular member 404 has dimensions of 0.930 inches for its inside diameter, 0.055 inches for its thickness and 0.985 inches for its outside diameter. The outer tubular member 404 is an elastomeric material such as a rubber hoselike material, a flexible plastic tube, or a plastic elastomer of any suitable type which can be inserted into the ground. Interiorly of the plastic pipe or tubular member 404 is a metal pipe which can be resilient plastic 406. The metal or resilient pipe 406 is configured in a manner whereby it receives the plastic or flexible pipe 404 around it. The metal pipe 406 is inserted into the flexible pipe 404 in a tight fitting relationship thereto so as to engage it and allow it to be implaced in the entirety as a combination with the two respective pipes 404 and 406 being implaced in the opening of the ground 400.

The pipe 406 can be substituted by any suitable resilient material such as a hard plastic, as well as the metal. One condition is that is should be implaced within the flexible tubular member 404 at a dimension below ground level. The pipe 404 can have its top surface or leading edge 408 at ground level, slightly above or slightly below ground level. However, the steel or resilient pipe 406 should be beneath its surface. In this particular case it has been shown to be approximately four inches below the ground level.

The foregoing creates a situation wherein the horses do not trod on the hard pipe 406 beneath the surface of the ground 440, but rather trod upon a flexible, or elastomeric pipe edge 408 which allows for the hoofs of the horses or any impact thereagainst to be received in a soft and cushioned manner. The pipe 404 can also be above the ground so that edge 408 is approximately one inch above the ground surface. By placing the edge 408 one inch above the ground surface at the depth of the grass, an opening 409 of the pipe 404 can be located and indexed. This allows for placement of the stanchions in a facile manner by readily locating the pipe 404 with its opening 409.

Within the pipe 406 and its opening 407 of the outer elastomeric cylinder or pipe 404, a stake, rod or stanchion holder is inserted. The stake can be of the type, such as stake 210 having a narrow rod portion 212. The narrow rod portion 212 is shown inserted into the outer plastic portion and passing therethrough into the opening of the metal pipe 406. The outside dimension of the rod portion 212 with the inside dimension of the pipe 406 should roughly match so as to allow for a slide fit of the rod portion 212 therein.

The stake 210 can have the belled flange 220 and a lower belled flange 22 as shown in FIG. 7. It can also incorporate the belled-out portions which terminate in shoulders 224 and 226. Each of the belled-out portions have a space respectively in the upper portion 230 and the lower portion 232 which allows the rod to pass therethrough in spaced relationship.

The foregoing configuration is not necessary so long as a stanchion post 200 or other member can be received over a stake 210. The stanchion post 200 can also be of any particular configuration. Stanchion 200 can be substituted by any other suitable stanchion such that an extending pipe portion, narrow rod portion or stake 212 can extend therefrom and be secured within the opening of pipe portion 406. Suffice it to say, any suitable means for holding stakes, rods, or stanchions in order to provide the rail of the invention for guarding horses can be utilized. Thus, a rail 110 of the type shown can be substituted by any other rail, such as the rail 18, as well as any particular stanchion or post 10 in order to allow for the overall ulitization and configuration of horse racing guard rails 110. The thought being that movement of the rails 110 or 18 can be effectuated by merely removing a post, such as post 10 or stanchion 200. This is accomplished by moving the posts or stanchions with the rods or stakes extending therefrom, from the stanchion receipt, rod receipt or ground fixtures provided by the respective tubes 404 and 406.

Figure 11:
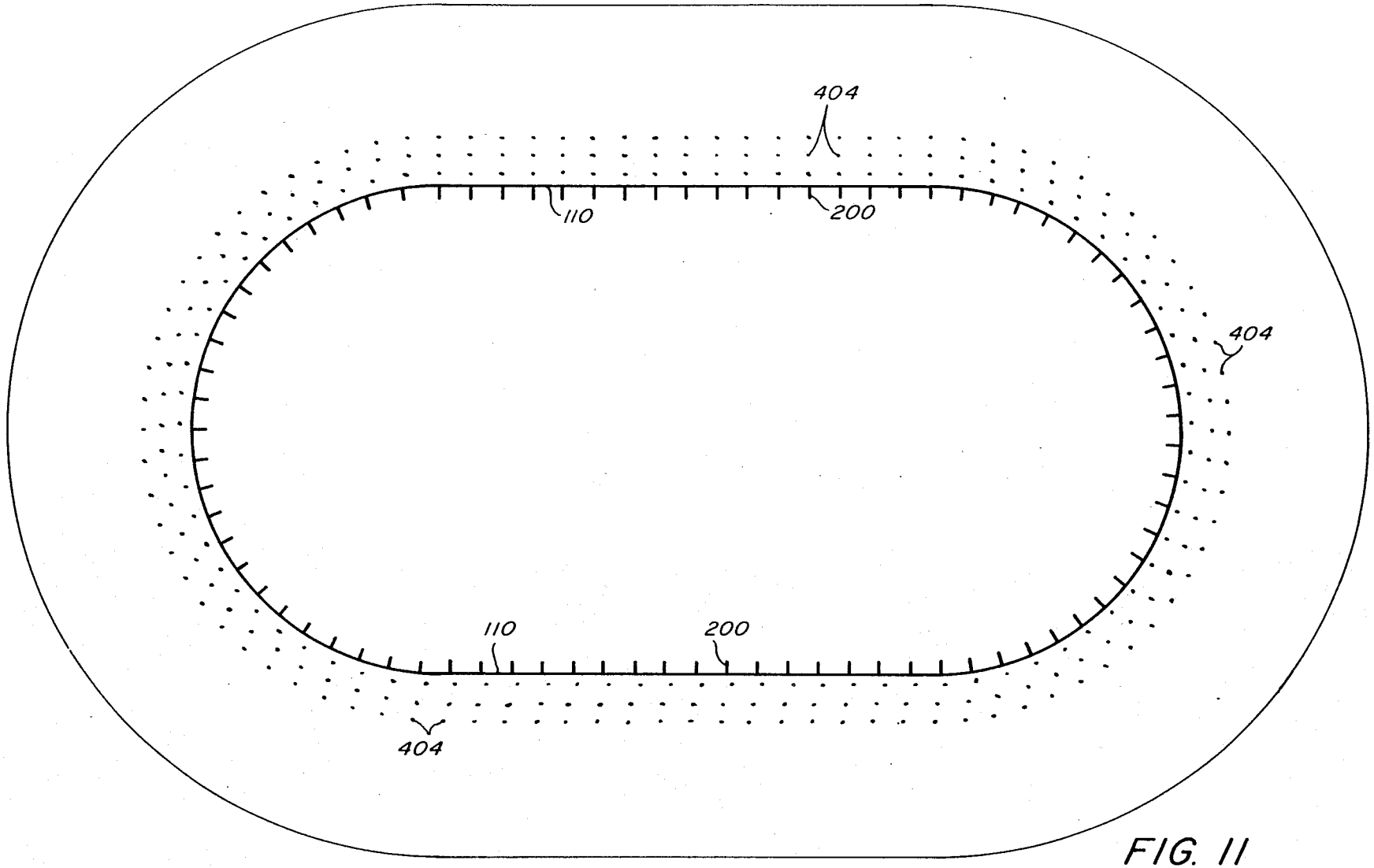
FIG. 11 shows a track with appropriate rail receipt members or fixtures shown in FIGS. 9 and 10 implaced in the track and having a rail implaced and inserted therein on the inner portion.

The foregoing allows for a grass track to have a number of such openings or fixtures provided by tubes 404 and 406 to be implaced in circumferential relationship around a grass track and the rail moved in and out therefrom. This can be seen in FIG. 11 wherein a number of tubes providing openings are seen in a pattern around a track. FIG. 11 shows tube locations 404 around the track at different interior and exterior track relationships to establish various running patterns. These running patterns are in a track relationship around the grass field or surface.

The rail 110 is shown having respective stanchions 200 supporting the rail. However, it should be understood that any particular rail, such as rails 18, 110 or any other particular type can be incorporated within the overall scheme to allow for movement of the rails inwardly and outwardly for various track sizes. In this manner, the track can be oriented to different dimensional configurations overlying various portions of the grass track so that wear on the grass is spread and thereby diminished. Furthermore, the rails can be moved easily inwardly and outwardly by merely pulling up the stanchions with the respective stakes, rods or inserts that are received within the pipes 404 and comprising the ground fixtures 406 and moving it into another location where the elastomeric pipes 404 are oriented with the pipes 406 therein. This allows for the horses to run over the pipes 404 with the inserts 406 therein and merely impact the top regions 408 with an elastomeric soft pipe to eliminate damage and impact against a horse's hoofs and danger to a rider falling. This is true when the pipe edge 408 extends an inch or more above the surface in the embodiment as shown.

The tubular members 404 and 406 can be round, rectangular, triangular or of any other cross section so long as they have inside configurations matching the stake 212 or other extension means for seating the posts or stanchions.

As a consequence of the foregoing, this invention is a substantial step over the art by allowing utility or rails for horse racing on a grass track. It also incorporates the ability of sulky racing rails or other rails and stanchions being incorporated on a movable basis on a grass track, the end result being that the various portions of the track are not worn. Also, the rails with the stakes or inserts 212 with the stanchions attached thereto can be readily moved to various locations without concern for the removal and thereby creating a hard member against which a horse or rider would impact. Thus, the foregoing invention allows easy movement of horse rails inwardly and outwardly for different locations and patterns on a horse track, whether it be grass or dirt, while at the same time providing for indexed insert areas which do not injure or hurt a horse. Thus, it should be read as an advance over the art as far as grass tracks and other horse racing rails and securement means are concerned.

I claim:

1. A ground fixture for utilization with a horse track rail and for receipt of said horse track rail comprising:

a first flexible tubular member formed from an elastomeric material;

a second tubular member formed of metal for receipt within said first flexible tubular member interiorly thereof and adapted for placement in the ground so that a portion of said first flexible tubular member extending beyond said second tubular member is in proximate relationship to the ground surface in which said tubular members are implaced; and, wherein said second tubular member is adapted for holding said racetrack rail.

2. A fixture as claimed in claim 1 wherein:

said racetrack rail comprises a rail member affixed to a postost; and, means for securing said post into said fixture within said second tubular member.

3. The fixture as claimed in claim 2 wherein said means for affixing said post to said fixture comprises:

a stake extending between said post and said fixture.

4. The fixture as claimed in claim 3 wherein:

said stake has an enlarged collar which is received within said post; and, having an extension of said stake which is received within the interior of said second tubular member of said fixture.

5. The combination of a racetrack rail and means for receiving said racetrack rail in an indexed location within the ground comprising:

a first tubular member formed from a flexible elastomeric material adapted for seating within the ground proximate to the ground surface;

a second tubular member made of metal telescopingly combined with said first tubular member and adapted to be placed within the ground below the surface of said ground so that said first tubular member will receive impacts at a level above said second tubular member;

a racetrack rail comprising a rail attached to posts with means extending from said posts into said tubular members.

6. The combination as claimed in claim 5 wherein:

said means extending from said posts comprise an extension adapted for fitting within said posts and within the interior of said second tubular members.

7. The combination as claimed in claim 6 further comprising:

posts formed with an angular bend therein and having said rail attached to the ends of said angular bend and an opening within the other end of said post adapted to receive said means extending between said tubular members and said post; and, collar means circumscribing said extending means for seating within said posts.

8. The combination as claimed in claim 6 wherein:

said rails are formed in segments for extending between said posts.

9. The combination as claimed in claim 7 wherein:

said posts have seating means for receiving said rails thereon and holding said rails in their incremental lengths to said posts.

10. The combination of a racetrack rail and a means for receiving said racetrack rail in the form of a ground fixture comrprising:

a ground fixture formed as a first flexible elastomeric tubular member;

a second tubular member made of metal telescopingly combined with said first flexible tubular member so that when said first and second tubular members are placed in the ground, said first tubular member extends beyond said second tubular member and receives impacts thereon at its flexible end extending beyond said second tubular member;

a post adapted for receipt of a rail at the end thereof; and, means for extending from said posts into said ground fixture.

11. The combination as claimed in claim 10 wherein:

said post is formed with means for receiving a rail therein in the form of a detachable collar; and wherein, said rail can be disassembled in lengths for attachment between said posts.

12. The combination as claimed in claim 10 further comprising:

means extending from said posts into said ground fixture in the form of a stake for seating within said tubular members.

13. The combination as claimed in claim 12 wherein said means extending from said posts into said tubular members of said ground fixture comprises:

a metal stake.

14. The combination as claimed in claim 12 further comprising:

a collar attached to said metal stake which expands the outer dimensions of said metal stake for receipt within said post for seating said post thereon.

15. The combination as claimed in claim 14 wherein said means for receiving said rails on said posts comprise:

a collar means which can be opened and has an inside dimension substantially matching the configuration of the outside dimension of said rail for receipt therein.

16. The combination as claimed in claim 15 further comprising:

a stake having at least two expanding portions thereon in the form of enlarged collars beyond the dimensions of said stake for receiving said posts thereover and having a stake adapted for extension into said second tubular member.

17. The combination as claimed in claim 10 wherein: said tubular members are round.

18. The combination as claimed in claim 10 wherein: said tubular members are rectangular.

* * * * *